US008172593B2

(12) United States Patent
Montena

(10) Patent No.: US 8,172,593 B2
(45) Date of Patent: May 8, 2012

(54) CABLE CONNECTOR EXPANDING CONTACT

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 431 days.

(21) Appl. No.: 12/434,283

(22) Filed: May 1, 2009

(65) Prior Publication Data

US 2009/0269979 A1 Oct. 29, 2009

Related U.S. Application Data

(63) Continuation-in-part of application No. 11/608,610, filed on Dec. 8, 2006, now Pat. No. 7,527,512.

(51) Int. Cl.
*H01R 13/62* (2006.01)
*H01R 13/15* (2006.01)
*H01R 9/05* (2006.01)

(52) U.S. Cl. ..... 439/265; 439/578; 29/861

(58) Field of Classification Search ..... 439/265, 439/578, 583, 584, 825; 29/861, 874, 881, 29/882

See application file for complete search history.

(56) References Cited

U.S. PATENT DOCUMENTS 3,219,751 A 11/1965 Pfendler et al.
3,706,958 A 12/1972 Blanchenot
3,744,011 A 7/1973 Blanchenot
3,764,959 A 10/1973 Toma et al.
3,846,738 A 11/1974 Nepovim
4,346,958 A 8/1982 Blanchard
4,384,758 A 5/1983 Lee et al.
4,588,241 A 5/1986 Ardezzone
4,834,676 A 5/1989 Tackett
5,066,249 A 11/1991 Doye et al.
5,362,251 A 11/1994 Bielak
5,435,745 A 7/1995 Booth
5,518,420 A 5/1996 Pitschi
5,697,871 A * 12/1997 Landfair ..... 482/82
6,133,532 A 10/2000 Lundback et al.
6,267,621 B1 7/2001 Pitschi et al.
6,331,123 B1 12/2001 Rodrigues
6,431,911 B2 8/2002 Pitschi
6,478,618 B2 11/2002 Wong
6,517,379 B2 2/2003 Leve (Continued)

OTHER PUBLICATIONS

PCT/US2010/032500 International Search Report and Written Opinion. Date of Mailing: Nov. 22, 2010. 8 pp.

*Primary Examiner* — Felix O Figueroa
(74) *Attorney, Agent, or Firm* — Schmeiser Olsen & Watts

(57) ABSTRACT

A coaxial cable connector includes a pin having a plurality of circumferentially spaced support arms, inward facing surfaces of the support arms defining a cavity. A shoulder is provided on the inward facing surfaces. A guide is axially received in the internal cavity, the guide having tabs at one and a radial flange at the other. An elastomeric cylindrical collar is disposed on the guide between the tabs and the flange. In a first position, the collar is axially uncompressed or axially partially compressed between the flange of the guide and the shoulders of the support arms. In a second position, the flange is positioned closer to the shoulders such that the collar is axially compressed between the flange and the shoulders to a shorter axial distance than in the first position and such that the collar is expanded radially outwardly to a greater amount than in the first position.

11 Claims, 9 Drawing Sheets

U.S. PATENT DOCUMENTS 6,634,906 B1 10/2003 Yeh
6,705,884 B1 3/2004 McCarthy
6,796,829 B1 9/2004 McCarthy
6,848,941 B2 2/2005 Wlos et al.
6,884,113 B1 4/2005 Montena
6,902,437 B1 * 6/2005 Wang ..... 439/265
6,955,561 B2 10/2005 Seymour et al.
6,955,562 B1 10/2005 Henningsen
7,008,264 B2 3/2006 Wild
7,131,868 B2 11/2006 Montena
7,303,435 B2 12/2007 Burris et al.
7,357,671 B2 4/2008 Wild et al.
7,357,672 B2 4/2008 Montena
7,478,475 B2 1/2009 Hall
7,527,512 B2 * 5/2009 Montena ..... 439/265
8,052,465 B1 * 11/2011 Chawgo ..... 439/578
2007/0105439 A1 5/2007 Burris et al.
2008/0020637 A1 1/2008 Montena
2008/0139047 A1 6/2008 Montena

* cited by examiner

CABLE CONNECTOR EXPANDING CONTACT

CROSS REFERENCE TO RELATED APPLICATIONS

This is a continuation-in-part of U.S. application Ser. No. 11/608,610 filed on Dec. 8, 2006 and published on Jun. 12, 2008 as US 2008/0139047.

FIELD OF THE INVENTION

This invention relates generally to the field of coaxial cable connectors and more particularly to a contact assembly within a connector for use with coaxial cables having a tubular center conductor.

BACKGROUND OF THE INVENTION

Some coaxial cables, typically referred to as hard line coaxial cables, include a center conductor that is constructed of a smooth-walled or corrugated, metallic (e.g., copper, aluminum, steel, copper clad aluminum, etc.) tube due to factors such as weight, cost, and flexibility. Such a center conductor is referred to herein as a tubular center conductor.

A tubular center conductor typically includes a hollow internal portion. Electrical connections to the tubular center conductor may be made within the hollow internal portion, because the electromagnetic signals within the coaxial cable pass using mainly the outer diametral portions of the tubular center conductor. Accordingly, coaxial cable connectors that are designed to work with such hard line coaxial cables typically include contacts that are extended within the hollow internal portion of the tube center conductor. Such coaxial cable connectors are referred to herein as hard line connectors.

The contacts used in many of these hard line connectors are held against the hollow internal portion by a support arm. Each of these contacts is located at or near an end of the support arm, which is cantilevered from a mounting position within the hard line connector. During installation, each of these support arms, along with its respective contact, is deflected to a smaller effective diameter during installation into the hollow internal portion. The amount of deflection may vary greatly.

Each support arm is designed to allow for an amount of elastic deflection before the support arm is plastically deformed. The amount of elastic deformation accounts for a variety of possible variations occurring between tubular center conductors. These variations may include manufacturing tolerances and design variations. These variations are typically small, but can be significantly large when the tubular center conductor is corrugated. It has been observed that many of such variations cause the support arms to deflect beyond their amount of elastic deflection and become plastically deformed during installation. Once the support arm is plastically deformed, it will not return to its original position after a deflection.

Any plastic deformation of the support arms may result in a poor electrical connection between the contacts and the hollow internal portion of the tubular center conductor. As described above, each contact may be held against the hollow internal portion by a respective support arm. An amount of pressure applied by each contact is determined by the amount of elastic deflection between a free-state position of each support arm and an installed-state position of the support arm. Accordingly, any amount of plastic deformation of the support arm during installation will result in a reduced free-state position and, therefore, a reduced pressure applied by each contact.

Previous attempts have been made to increase the amount of elastic deflection available to each support arm by reducing the cross sectional thickness of the support arm. This reduction in the cross sectional thickness naturally allows for greater elastic deflections before the support arm becomes plastically deformed. It is important to note, however, that this reduction in the cross sectional thickness correspondingly reduces the amount of pressure is applied to the contact. Any reduction in, or elimination of the amount of pressure applied to the contact may reduce the quality of the connection and degrade the signal.

Other attempts have been made to increase the amount of pressure applied to the contact by various methods, such as increasing the cross sectional thickness of each support arm and using more resilient materials. This increase in the amount of pressure comes with a strong disadvantage of increasing an amount of moving force required to install the contact assembly into the hollow internal portion of the tubular center conductor. This increased installation force may result in damaged contacts and/or an incomplete installation. Both of these outcomes may reduce the quality of the connection and degrade the signal.

SUMMARY OF THE INVENTION

The present invention helps to increase the quality of the connections made between the coaxial cable and the connectors. The present invention ensures that the contacts of the connectors are held against the tubular center conductor with an amount of pressure. The present invention provides for such pressure without requiring additional or increased installation forces.

In accordance with one embodiment of the present invention, a coaxial cable connector is provided that includes a pin having first and second ends. The pin has a plurality of circumferentially spaced support arms terminating at the second end. Inward facing surfaces of the support arms define an internal cavity. A shoulder is provided on the inward facing surface of each of the support arms, and the shoulder is placed a distance from the second end. The connector further includes a guide that is axially received in the internal cavity. The guide has at a first end a plurality of tabs, which fit into respective slots formed between the support arms. The guide has a second end opposite the first end, and the second end has a generally radially extending flange. The connector further includes a cylindrical collar that is disposed concentrically on the guide and extends between the tabs and the flange. The collar is composed of an elastomeric material, and at least a portion of the collar is positioned within the internal cavity. In a first position, the cylindrical collar is one of axially uncompressed and axially partially compressed between the flange of the guide and the shoulders of the support arms. In a second position, the flange is positioned closer to the shoulders such that the collar is axially compressed between the flange and the shoulders to a shorter axial distance than in the first position in a manner that can change how the collar is one of axially uncompressed and axially partially compressed relative to the first position, and such that the collar is expanded radially outwardly to a greater amount than in the first position.

In accordance with one embodiment of the present invention, the collar is composed of a rubber material. Preferably, the collar is composed of silicone rubber.

In accordance with one embodiment of the present invention, the tabs are disposed at an end of the slots in the second position.

In accordance with one embodiment of the present invention, the pin and guide are components within a cable connector, which connects to a coaxial cable having a tubular center conductor. In the first position, the pin and the guide are moveable into and out of the tubular center conductor by a relatively low moving force, and in the second position, the support arms and contacts formed thereon are pressed radially outwardly to a greater degree than in the first position. A pressure of the contacts against the tubular center conductor creates a moving force that is greater than the relatively low moving force.

In accordance with one embodiment of the present invention, the cable connector further includes an insulator. The tabs of the guide make contact with the insulator to radially center the pin and the guide within the cable connector.

In accordance with one embodiment of the present invention, a method is provided for attaching a connector to a coaxial cable having a tubular center conductor. The method includes providing a pin having first and second ends. The pin has a plurality of circumferentially spaced support arms terminating at the second end. Inward facing surfaces of the support arms define an internal cavity. A shoulder is provided on the inward facing surface of each of the support arms, and the shoulder is placed a distance from the second end. The method further includes providing a guide that is axially received in the internal cavity. The guide has at a first end a plurality of tabs, which fit into respective slots formed between the support arms. The guide has a second end opposite the first end, and the second end has a generally radially extending flange. The method further includes mounting a cylindrical collar concentrically on the guide so as to extend between the tabs and the flange, the collar being composed of an elastomeric material. The method further includes inserting the pin and the collar into the internal cavity with the plurality of tabs fitting into the respective slots. The method further includes moving the guide further into the cavity. The collar is axially compressed between the flange of the guide and the shoulders of the support arms to thereby cause the collar to expand radially outwardly.

In accordance with one embodiment of the present invention, the method includes mounting a cylindrical collar that is composed of a rubber material. Preferably, the collar is composed of silicone rubber.

In accordance with one embodiment of the present invention, the method includes providing a guide that has tabs that are disposed at an extreme end of the slots when the collar is in a compressed condition.

In accordance with one embodiment of the present invention, the method further includes providing an insulator and having the tabs engage the insulator to hold both the pin and the guide radially centered within the cable connector.

BRIEF DESCRIPTION OF THE DRAWINGS

For a further understanding of the nature and objects of the invention, references should be made to the following detailed description of a preferred mode of practicing the invention, read in connection with the accompanying drawings in which.

DETAILED DESCRIPTION OF THE INVENTION

Figure 1:
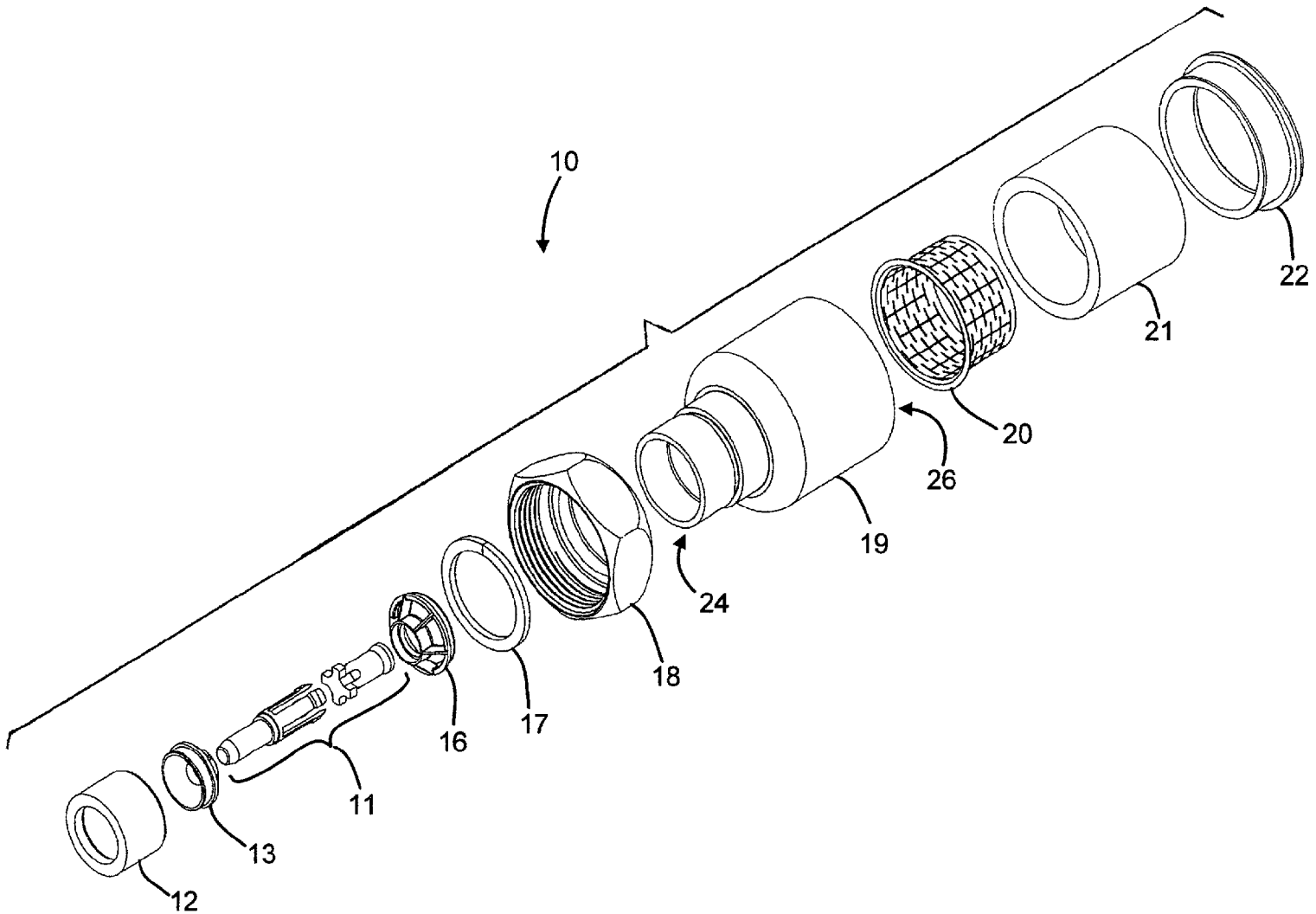
FIG. 1 shows a perspective exploded view of the parts of a hard line connector according to an embodiment of the invention.

Referring to FIG. 1, a hard line connector 10 according to an embodiment of the invention is shown in exploded form. The connector 10 includes a fastener 18 axially assembled onto a forward end 24 of an outer body 19. The fastener 18 is held on the outer body 19 using a snap ring 17, such that the fastener 18 can rotate in relation to the outer body 19.

A mesh body 20 and an elastomeric clamp 21 are inserted into a rearward end 26 of the outer body 19. A compression sleeve 22 is then placed in the rearward end 26 of the outer body 19.

A contact assembly 11 is positioned between a first insulator 13 and a second insulator 16. The contact assembly 11, the first insulator 13, the second insulator 16, and a sliding retainer 12 are inserted into the forward end 24 of the outer body 19. In the embodiment shown, the sliding retainer 12 is preferably constructed from a conductive material such as metal, and the sliding retainer 12 is installed into the outer body 19 with an interference fit between the sliding retainer and the outer body 19. If there is adequate electrical contact between the outer body 19 and the fastener 18, the sliding retainer 12 may not need to be electrically conductive.

The term interference fit is used herein to describe a method of assembly that provides a retention force between the sliding retainer 12 and the outer body 19. This retention force may be created as a result of a dimensional interference between the sliding retainer 12 and the outer body 19. The retention force may also be created by other known methods, such as methods that include an adhesive, interlocking mechanical components, and other devices and implements that can create the retention force.

Figure 2:
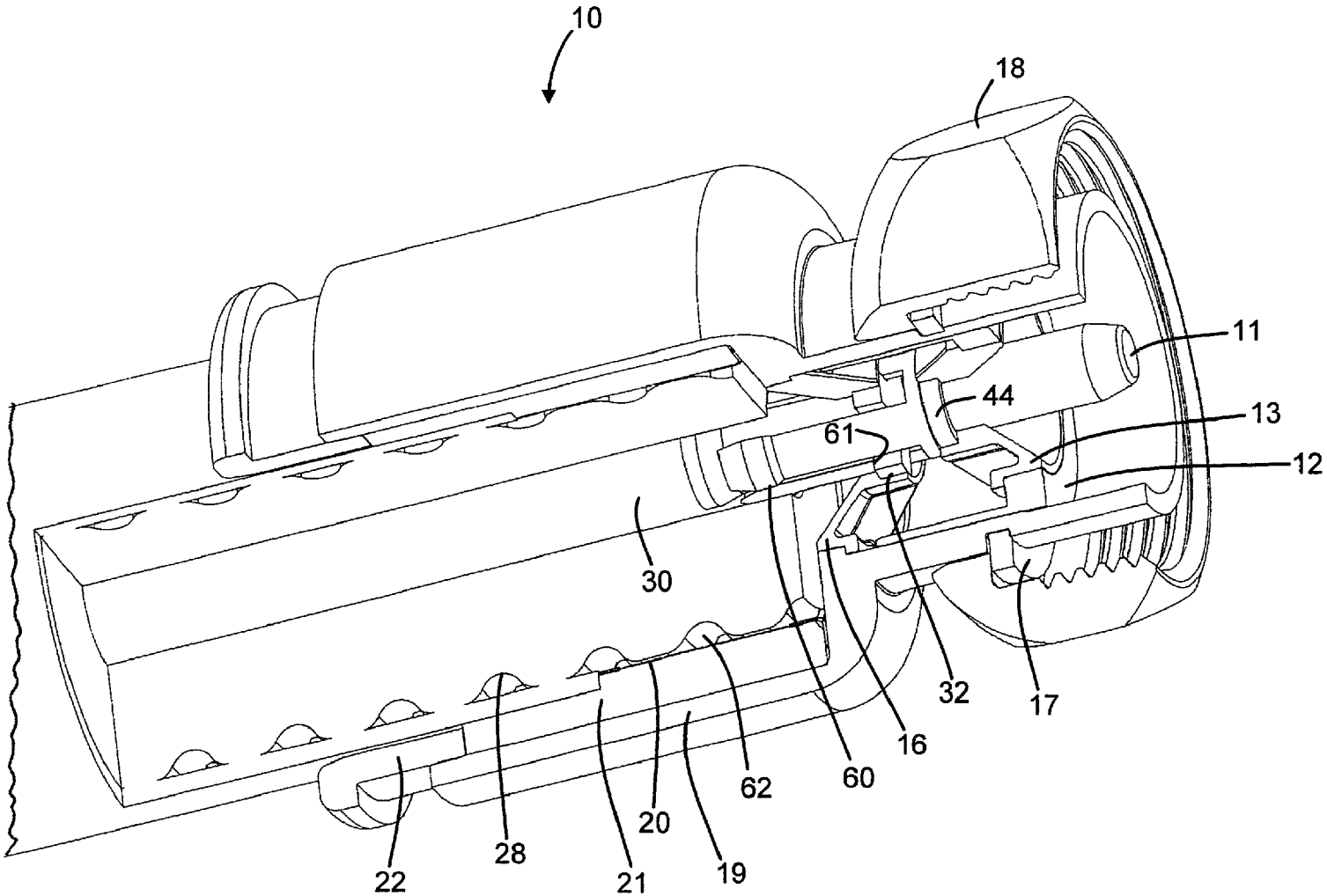
FIG. 2 shows a partial cutaway perspective view of a hard line connector according to an embodiment of the invention which is in a first position of clearance within a tubular center conductor of a hard line coaxial cable.

Referring now to FIG. 2, a coaxial cable 28, which includes a tubular center conductor 30, is attached to the connector 10 as follows. The mesh body 20, the elastomeric clamp 21, and the compression sleeve 22 are removed from the outer body 19. A portion of an outer conductor 62 of the coaxial cable 28 is exposed for contact with the mesh body 20. The cable 28 is then inserted through the compression sleeve 22, the elastomeric clamp 21, and the mesh body 20 with the mesh body 20 positioned close to the end of the cable 28. A portion of the cable 28 is then positioned within the outer body 19 and the compression sleeve 22 is forced into the outer body 19, squeezing the elastomeric clamp 21 and the mesh body 20 into the outer conductor 62 of the cable 28. The cable 28 is held in place within the connector 10 as a result of an axial compression of the compression sleeve 22.

Figure 3:
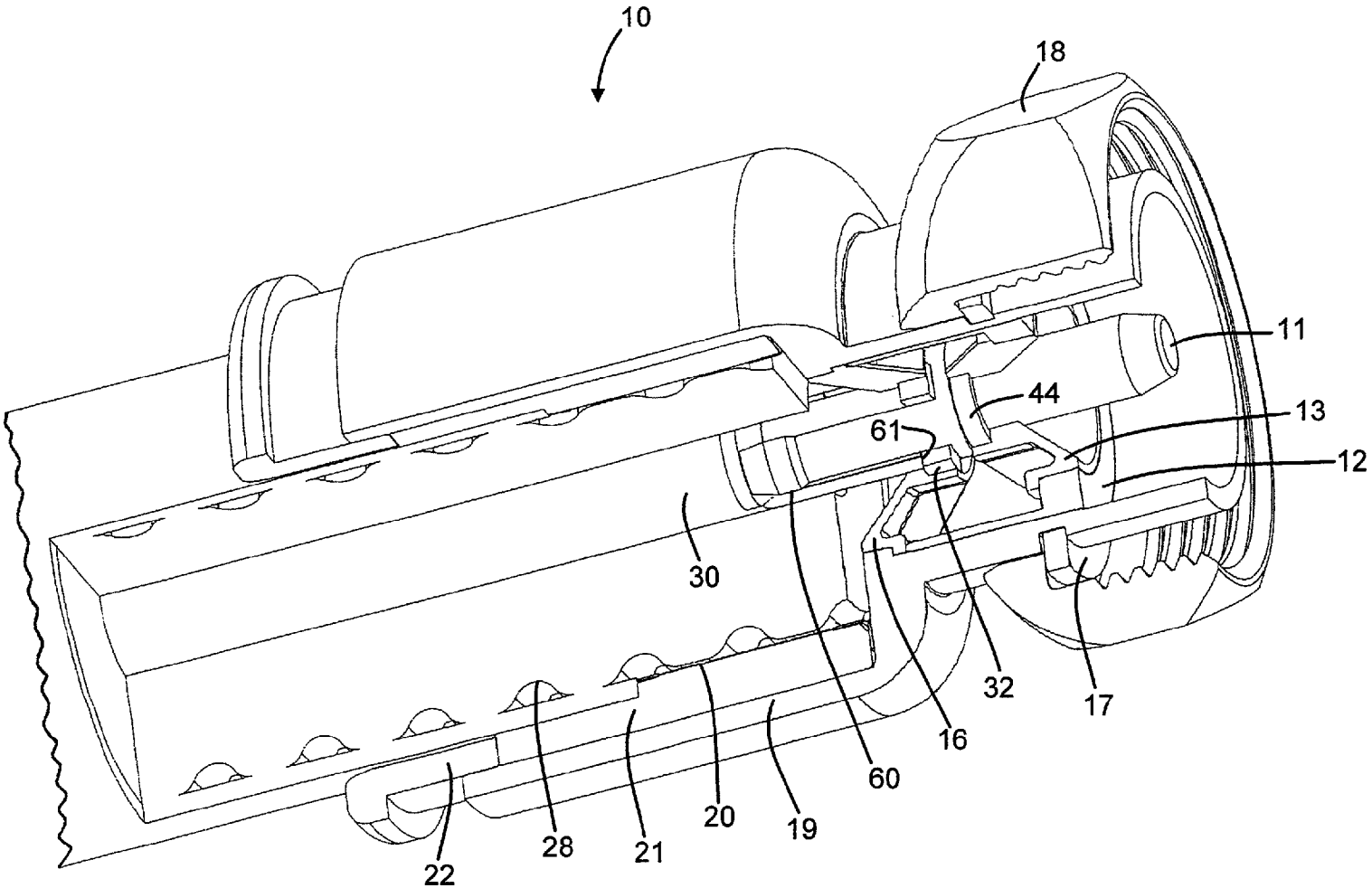
FIG. 3 shows a partial cutaway perspective view of the hard line connector of FIG. 2 that is in a second position of interference within the tubular center conductor of a hard line coaxial cable.

Referring now to FIGS. 2 and 3, the contact assembly 11 is moved from a first position of clearance (FIG. 2) into a second position of interference (FIG. 3) when the sliding retainer 12 is pushed toward the cable 28. The movement of the sliding retainer 12 repositions the first insulator 13 in relation to the second insulator 16. Accordingly, a ridge 44 of the contact assembly 11 is pushed toward tabs 32 of the contact assembly 11. The relative movement between the ridge 44 and the tabs 32 of the contact assembly 11 will be discussed in greater detail below in relation to a first embodiment (FIGS. 4 and 5) and a second embodiment (FIGS. 6-9) of the contact assembly 11. The ridge 44, the tabs 32 and the contacts 60 (discussed below) in each of the first embodiment and the second embodiment use the same reference numbers to avoid confusion. The relative functions of the ridge 44, the tabs 32, and the contacts 60 are similar between the two embodiments.

Figure 4:
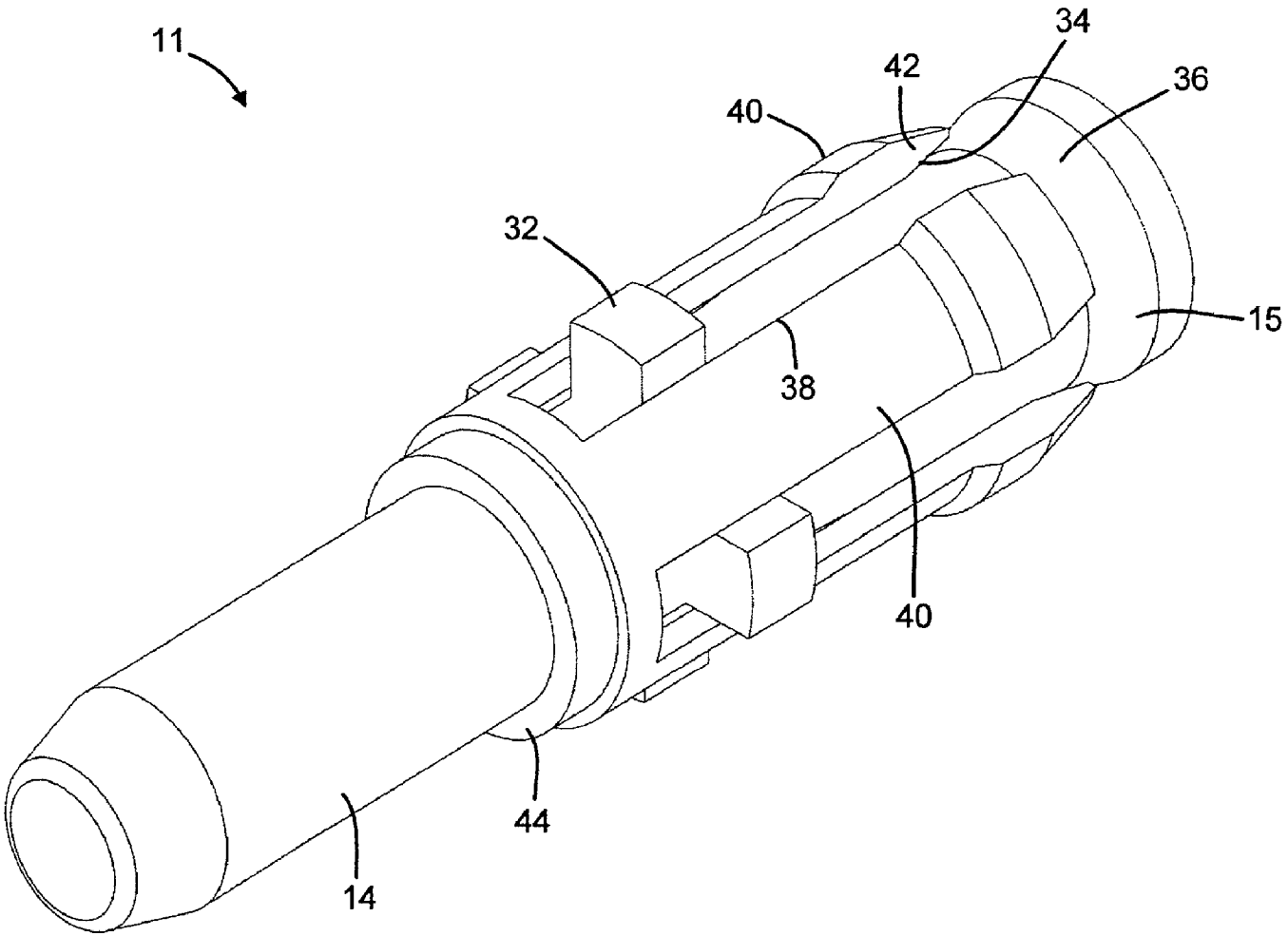
FIG. 4 shows a perspective view of a contact assembly according to an embodiment of the present invention in a first position of clearance.
Figure 5:
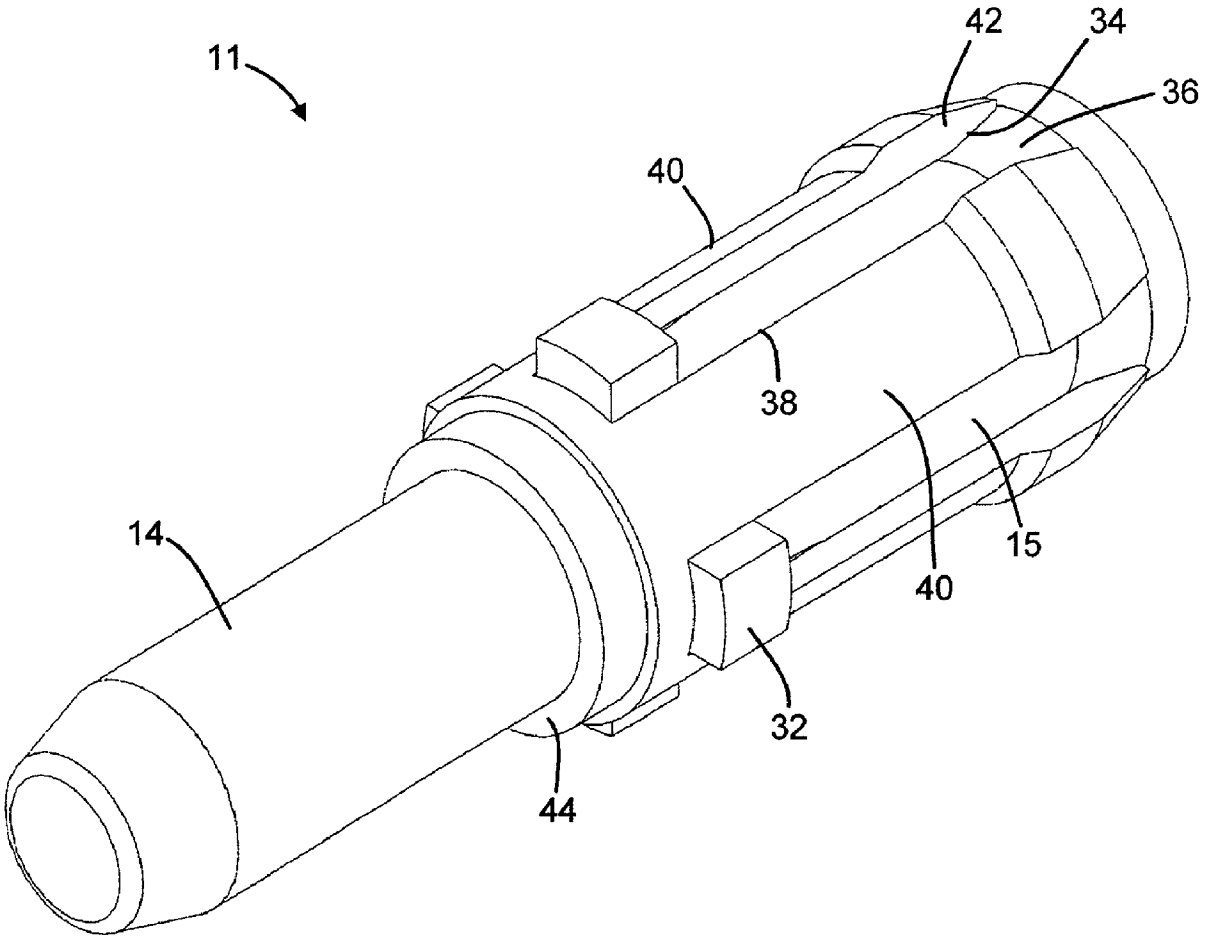
FIG. 5 shows a perspective view of the contact assembly of FIG. 4 in a second position of interference.
Figure 7:
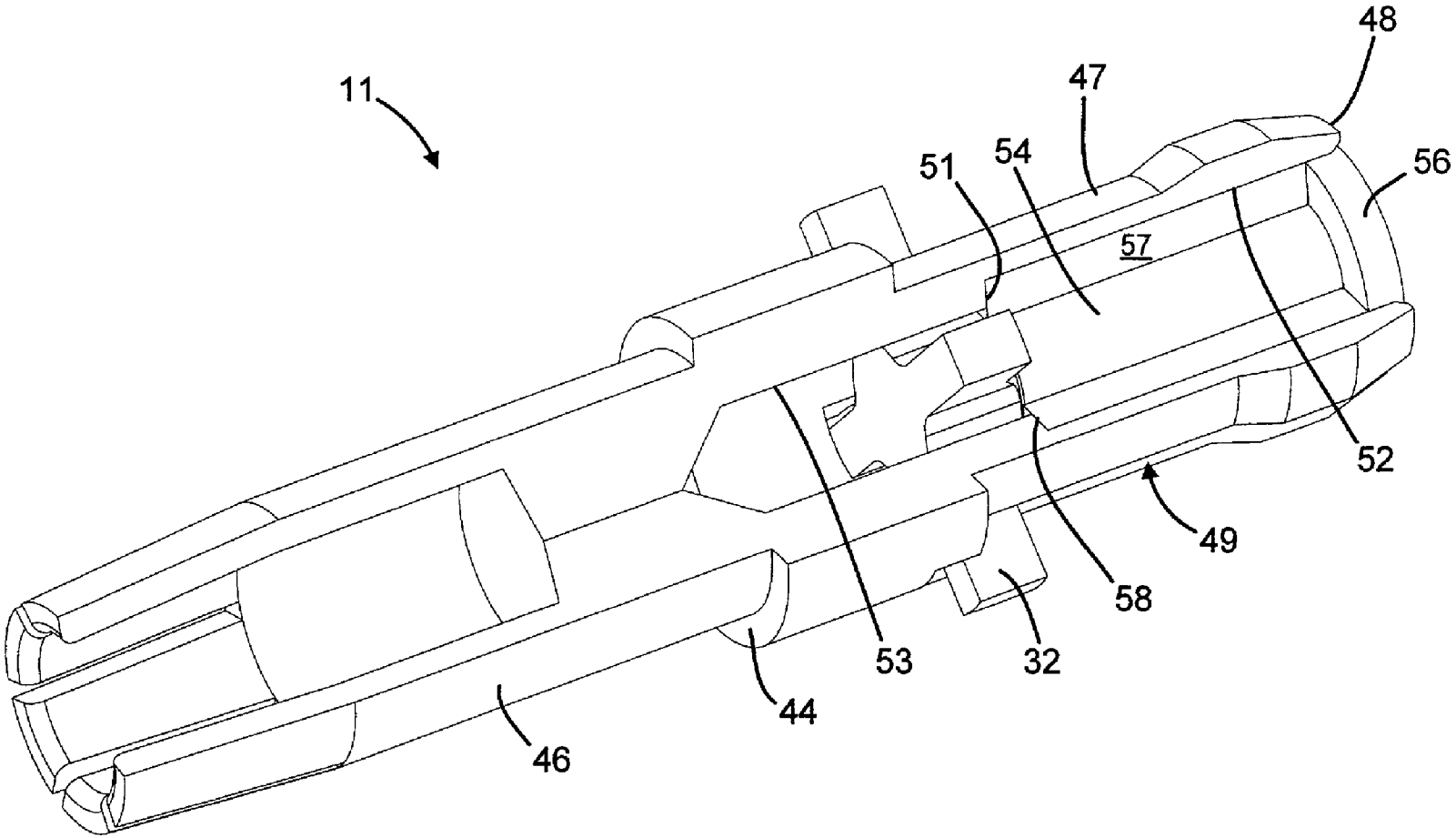
FIG. 7 shows a perspective view of the contact assembly of FIG. 6 in a first position of clearance.
Figure 8:
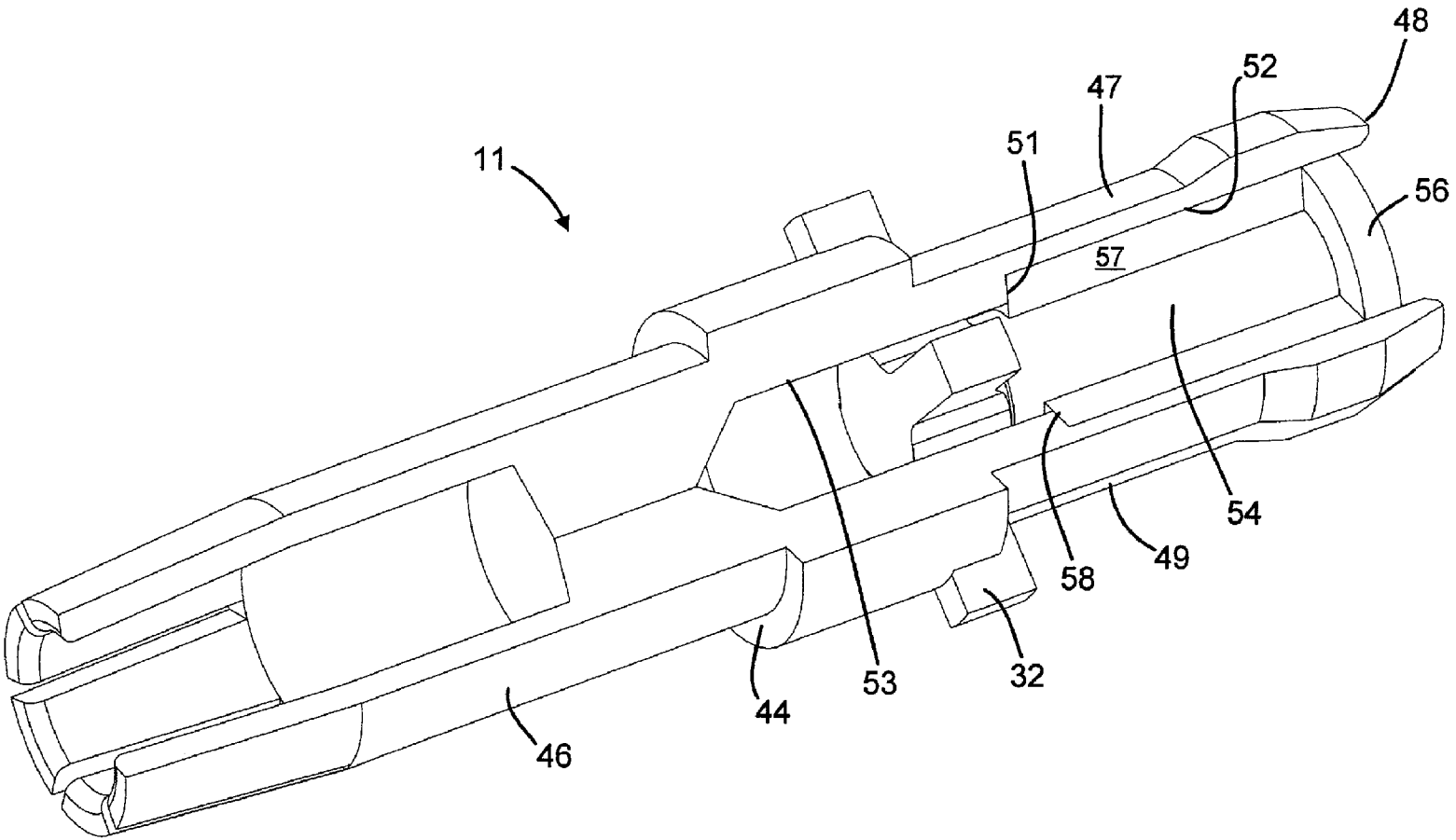
FIG. 8 shows a perspective view of the contact assembly of FIG. 6 in a second position of interference.
Figure 9:
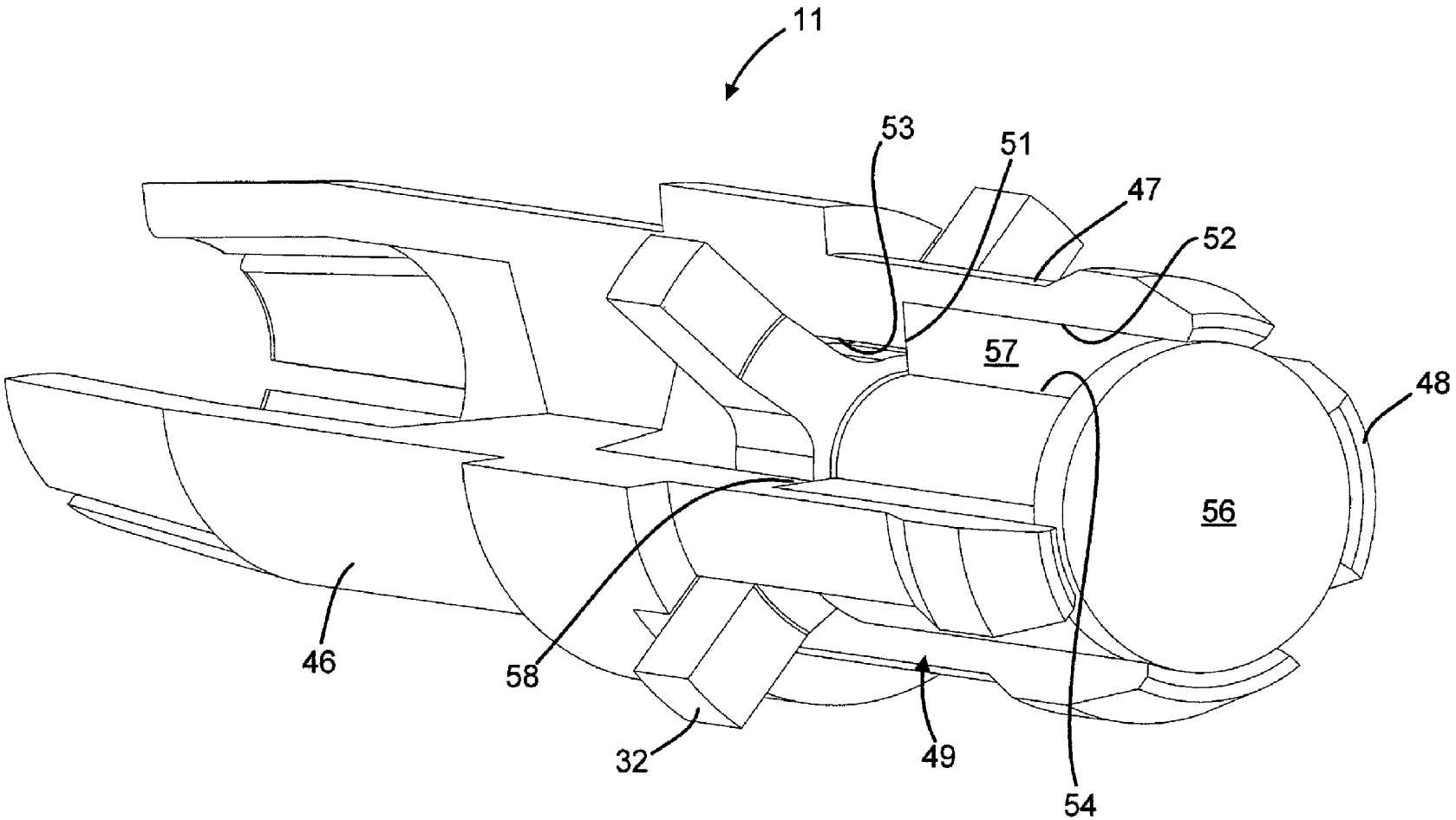
FIG. 9 shows a partial cutaway perspective view of the contact assembly of FIG. 8.

The first embodiment of the contact assembly 11 is shown in FIGS. 4 and 5. FIG. 4 shows the contact assembly 11 in the first position of clearance (FIG. 2), and FIG. 5 shows the contact assembly 11 in the second position of interference (FIG. 3). The second embodiment of the contact assembly 11 is shown in FIGS. 6-9. FIG. 7 shows the contact assembly 11 in the first position of clearance (FIG. 2), and FIGS. 8 and 9 show the contact assembly 11 in the second position of interference (FIG. 3).

Referring to FIG. 4, a pin 14 includes a plurality of slots 38, which create a plurality of finger-like support arms 40. A guide 15 includes a plurality of corresponding tabs 32 that fit within the slots 38. The tabs 32 are sized to extend beyond the slots 38 a distance sufficient to engage a mating surface 61 (FIGS. 2 and 3) on the second insulator 16. Each support arm 40 includes a ramped portion 34 on an underside of an end 42. The ramped portion 34 on the support arm 40 interacts with a ramped portion 36 at or near an end of the guide 15 opposite the tabs 32. A contact 60 is located on an outer surface of each support arm 40, the outer surface being the surface intended to directly face the tubular center conductor 30 within the hollow internal portion of the coaxial cable 28.

In the first position of clearance shown in FIG. 4, the contact assembly 11 will slide into and out of the tubular center conductor 30 of the cable 28 (FIG. 2) with a relatively low moving force. The relatively low moving force will occur when the contacts 60 are pressed, even lightly, against the tubular center conductor 30 during assembly. It should be noted, that this relatively low moving force includes the possibility of a very low or no moving force being required to insert the contact assembly 11 when the contacts 60 on the pin 14 do not touch the tubular center conductor 30. For example, with this relatively low moving force, the contact assembly 11 can be slid into the hollow internal portion of the tubular center conductor 30 with less force than would be required when the connector assembly 11 is in the second position of interference.

In the second position of interference shown in FIG. 5, the ends 42 of support arms 40 and the contacts 60 are being supported by the ramped portions 34 of the support arms 40 interacting with the ramped portion 36 of the guide 15. This additional support provides additional contact pressure between the contacts 60 and the tubular center conductor 30. This additional contact pressure increases the moving force required to displace the connector assembly 11 within the tubular center conductor 30, the increased moving force being greater than the relatively low moving force described above in relation to the first position of clearance.

It is envisaged that the ends 42 of the individual support arms 40 will be moved outward by the transition of the guide 15 from the first position of clearance to the second position of interference. It should be noted, however, that such movement of the support arms 40 and the contacts 60 is not required. For example, when the pin 14 is not inserted within the hollow inner portion of the tubular center conductor 30, the ends 42 of the support arms 40 may remain in the same or nearly the same position such that an effective diameter circumscribing the contacts 60 remains the same or nearly the same. In the second position of interference, the ends 42 of the support arms 40 may be supported more closely by the guide 15 such that the pressure required to deflect the contacts 60 to an inner diameter of the tubular center conductor 30 is greater than when the guide 15 is in the first position of clearance. It is this difference in contact pressure that changes the moving force required to displace the connector assembly within the tubular center conductor 30.

Figure 6:
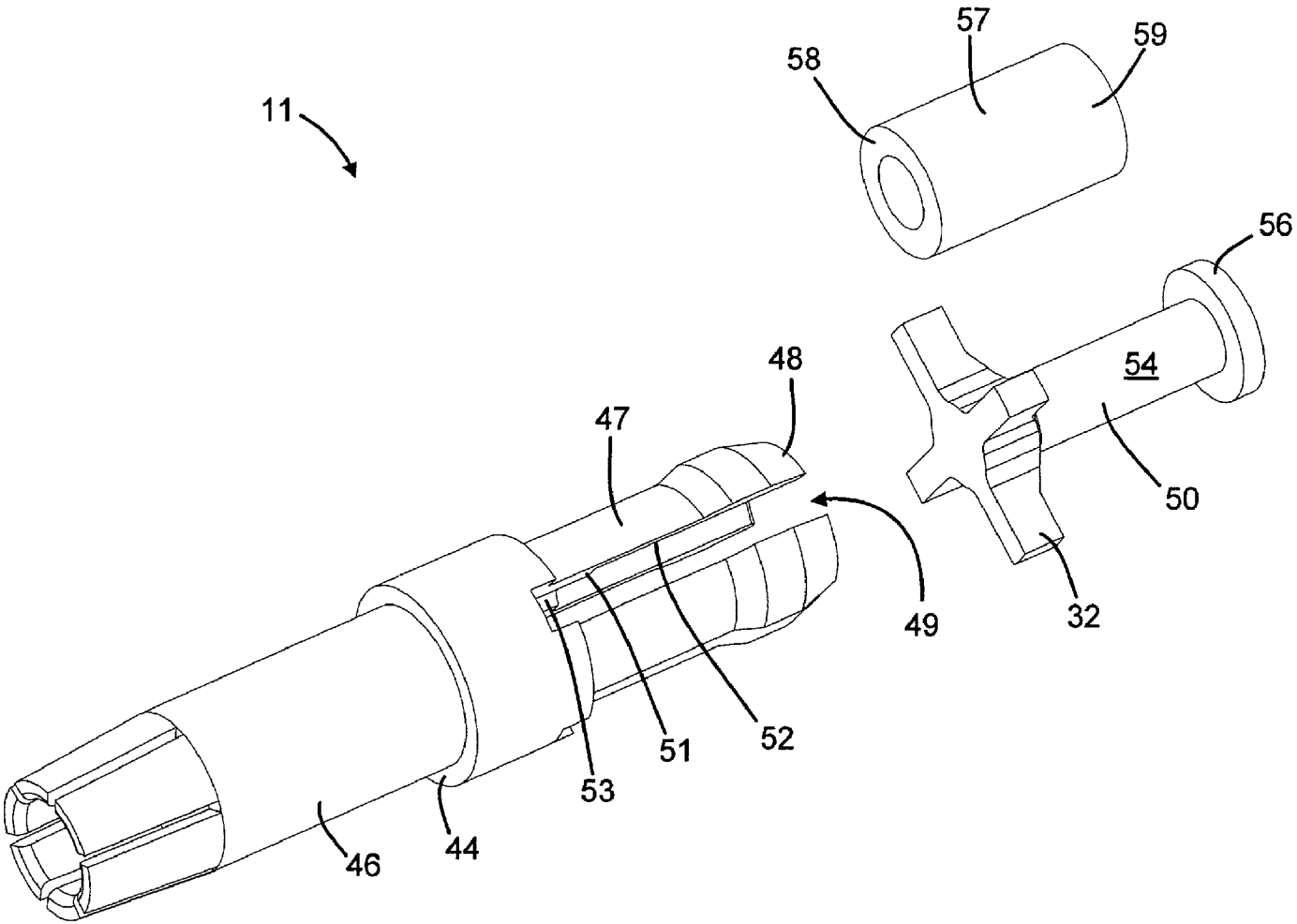
FIG. 6 shows a perspective exploded view of a contact assembly according to an alternative embodiment of the present invention.

Referring now to FIG. 6, the second embodiment of the contact assembly 11 is shown in exploded form. The second embodiment of the contact assembly 11 includes a pin 46, a guide 50, and a cylindrical collar 57. Similar to pin 14 described above, the pin 46 includes a ridge 44. Further, the pin 46 has a plurality of circumferentially spaced slots 49 at one end defining a plurality of finger-like support arms 47 with ends 48. A contact 60 is positioned on an outer surface of each support arm 47. Each of the support arms 47 includes a substantially radially extending shoulder 51, which is disposed between a larger internal diameter portion 52 and a smaller internal diameter portion 53. The function of these elements will be described more fully below.

The guide 50 is similar to the guide 15 described above in that it includes a plurality of circumferential spaced tabs 32, which fit into and extend through the slots 49 of the pin 46 to engage a mating surface 61 (FIGS. 2 and 3) of the second insulator 16. The tabs 32 are disposed on one end of a shaft portion 54, and a radially extending flange 56 is disposed on the other end thereof.

The cylindrical collar 57 is concentrically disposed over the shaft portion 54, between the tabs 55 and the flange 56. The cylindrical collar 57 has coaxial ends 58 and 59 and is composed of a material that has a relatively low Young's modulus of between 1 and 25 MPa, like natural rubber, nitrile rubber, silicone rubber, styrene butadiene rubber, ethylene propylene diene rubber, urethane rubber, etc. Elastomers having a relatively low Young's modulus can be elastically compressed in an axial direction to create a radial deflection of the elastomer with a relatively low compressive force. Such elastomers should also have relatively low compressibility properties such that the material maintains a relatively consistent volume during an elastic deflection. This characteristic allow for an efficient transfer of an axial deflection into a radial deflection. It has been found that silicone rubber is a suitable material for the collar 57.

The term "relatively" is used above in an effort to define the desired properties of the collar 57 while allowing design modifications that are envisaged to be within the scope of the present invention. In other words, it is envisaged that the collar 57 could be manufactured of a more rigid and/or more compressible material. In the case of a more rigid material, the collar 57 could be made having a thinner cross section and/or the installation tools could be made to provide a greater amount of installation force. Similarly, it is envisaged that a more compressible material could be used for the collar 57 when less actual radial deflection is desired while using the same amount of axial deflection.

Referring now to FIG. 7, the contact assembly 11 is shown in the first position of clearance. The collar 57, which is mounted on the shaft portion 54, can be axially inserted into the larger inner diameter portion 52 of the support arm 47. The inner end 58 of the collar 57 abuts the shoulder 51, and the outer end 59 of the collar 57 is engaged by the flange 56 of the guide 50. The tabs 32 are not at the end of the slots 49 but are spaced therefrom. In this first position of clearance, the collar 57 is exerting relatively little, if any, force against the support arms 47. Similar to the first embodiment discussed above, the contacts 60 of the second embodiment of the contact assembly 11 can be inserted into the hollow internal portion of a tubular center conductor 30 using the relatively low moving force when the contact assembly 11 is in the first position of clearance.

In the second position of interference shown in FIGS. 8 and 9, the guide 50 is moved in relation to the pin 46 so that the contacts 60 can apply a greater pressure against the hollow internal portion of the tubular inner conductor 30. As discussed above in relation to the first embodiment, the additional contact pressure will increase the moving force required to displace the contact assembly 11 within the tubular center conductor 30.

Similar to the first embodiment, the relative axial movement between the ridge 44 and the tabs 32 is initiated by an axial movement of the sliding retainer 12. The tabs 32 hold the position of the guide 50 stationary in relation to the second insulator 16, and the pin 46 is advanced over the guide 50 because of the axial movement of the sliding retainer 12 and the first insulator 13. As the pin 46 and its support arms 47 are moved further toward the guide 50, the shoulder 51 causes the collar 57 to be axially compressed. In the process, the collar 57 expands radially outwardly to press against the support arms 47. At the same time, the tabs 32 come to rest at the end of the slots 49.

Similar to the first embodiment discussed above, it is envisaged that ends 48 of the individual support arms 47 will be moved outward by the transition of the guide 50 from the first position of clearance to the second position of interference. It should be noted, however, that such movement of the support arms 47 and the contacts 60 is not required. For example, when the pin 46 is not inserted within the hollow inner portion of the tubular center conductor 30, the ends 48 of the support arms 47 may remain in the same or nearly the same position such that an effective diameter circumscribing the contacts 60 remains the same or nearly the same. In the second position of interference (FIGS. 8 and 9), the ends 48 of the support arms 47 may be supported more closely by the guide 50 and the collar 57 such that the pressure required to deflect the contacts 60 to an inner diameter of the tubular center conductor 30 is greater than when the guide 50 is in the first position of clearance (shown in FIG. 7). It is this difference in contact pressure that changes the moving force required to displace the connector assembly within the tubular center conductor 30.

As will be understood, because of the flexibility of the collar 57, there exists a range of possible motion of the support arms 47 in the radial direction. In this way, the same connector can be used with coaxial cables having internal diameters that vary due to manufacturing tolerance and/or corrugations.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

I claim:

1. A coaxial cable connector comprising:

a pin having first and second ends, the pin having a plurality of circumferentially spaced support arms terminating at the second end, and inward facing surfaces of the support arms defining an internal cavity;

a shoulder provided on the inward facing surface of each of the support arms, the shoulder being placed a distance from the second end;

a guide being axially received in the internal cavity, the guide having at a first end a plurality of tabs which fit into respective slots formed between the support arms, and the guide having a second end opposite the first end, the second end having a generally radially extending flange; and a cylindrical collar disposed concentrically on the guide and extending between the tabs and the flange, the collar being composed of an elastomeric material, and at least a portion of the collar being positioned within the internal cavity, wherein in a first position, the cylindrical collar is one of axially uncompressed and axially partially compressed between the flange of the guide and the shoulders of the support arms, and wherein in a second position, the flange is positioned closer to the shoulders such that the collar is axially compressed between the flange and the shoulders to a shorter axial distance than in the first position and such that the collar is expanded radially outwardly to a greater amount than in the first position.

2. The coaxial cable connector as set forth in claim 1 wherein the collar is composed of a rubber material.

3. The coaxial cable connector as set forth in claim 2 wherein the collar is composed of silicone rubber.

4. The coaxial cable connector as set forth in claim 1 wherein, the tabs are disposed at an end of the slots in the second position.

5. The coaxial cable connector as set forth in claim 1, wherein the pin and guide are components within a cable connector which connects to a coaxial cable having a tubular center conductor, wherein, in the first position, the pin and the guide are moveable into and out of the tubular center conductor by a relatively low moving force, and wherein, in the second position, the support arms and contacts formed thereon are pressed radially outwardly to a greater degree than in the first position, a pressure of the contacts against the tubular center conductor creates a moving force that is greater than the relatively low moving force.

6. The coaxial cable connector as set forth in claim 5 wherein the cable connector further comprises an insulator, and wherein the tabs of the guide make contact with the insulator to radially center the pin and the guide within the cable connector.

7. A method of attaching a connector to a coaxial cable having a tubular center conductor, the method comprising:

providing a pin having first and second ends, the pin having a plurality of circumferentially spaced support arms terminating at the second end, inward facing surfaces of the support arms defining an internal cavity, and a shoulder provided on the inward facing surface of each of the support arms, the shoulder being placed a distance from the second end;

providing a guide being axially received in the internal cavity, the guide having at a first end a plurality of tabs which fit into respective slots formed between the support arms, and the guide having a second end opposite the first end, the second end having a radially extending flange; and mounting a cylindrical collar concentrically on the guide so as to extend between the tabs and the flange, the collar being composed of an elastomeric material;

inserting the pin and the collar into the internal cavity with the plurality of tabs fitting into the respective slots; and moving the guide further into the cavity, the collar being axially compressed between the flange of the guide and the shoulders of the support arms to thereby cause the collar to expand radially outwardly.

8. The method as set forth in claim 7 wherein the collar is composed of a rubber material.

9. The method as set forth in claim 8 wherein the collar is composed of silicone rubber.

10. The method as set forth in claim 7 wherein, when the collar is in a compressed condition, the tabs are disposed at an extreme end of the slots.

11. The method as set forth in claim 7 further comprising providing an insulator; and having the tabs engage the insulator to hold both the pin and the guide radially centered within the cable connector.

* * * * *